US006352242B1

(12) United States Patent
Medearis

(10) Patent No.: US 6,352,242 B1
(45) Date of Patent: Mar. 5, 2002

(54) POST REMOVAL DEVICE

(76) Inventor: Robert C. Medearis, 11395 N. Woodburn Rd., Byron, IL (US) 61010

( * ) Notice: Subject to any disclaimer, the term of this patent is extended or adjusted under 35 U.S.C. 154(b) by 0 days.

(21) Appl. No.: 09/928,080

(22) Filed: Aug. 10, 2001

(51) Int. Cl.[7] ..... E21B 19/00
(52) U.S. Cl. ..... 254/30
(58) Field of Search ..... 254/30, 131, 113, 254/108, 120, 133 R, DIG. 1, DIG. 4, 29 R

(56) References Cited

U.S. PATENT DOCUMENTS

| | | | | |
|---|---|---|---|---|
| 654,001 A | | 7/1900 | Hull | |
| 2,777,726 A | | 1/1957 | Lundgren et al. | |
| 2,926,890 A | | 3/1960 | Majors | |
| D337,412 S | | 7/1993 | Ruggles | |
| 5,499,795 A | | 3/1996 | Mathews | |
| 5,681,030 A | | 10/1997 | Nall | |
| 5,794,918 A | * | 8/1998 | Price | 254/30 |
| 5,833,215 A | * | 11/1998 | Vandenburg | 254/30 |
| 6,302,377 B1 | * | 10/2001 | Pimentel | 254/30 |

* cited by examiner

*Primary Examiner*—Joseph J. Hail, III
*Assistant Examiner*—Lee Wilson

(57) ABSTRACT

A post removal device for removing fence posts having lugs thereon. The post removal device includes an elongated member having a first end and a second end. The elongated member has middle portion, a first wall and a second wall such that the elongated member generally has U-shaped cross-section taken traverse to a longitudinal axis of the elongated member. A plate is attached to the first end of the elongated member. The plate lies in a plane orientated generally perpendicular to the longitudinal axis of the plate. A catch is attached to the elongated member and is positioned nearer the second end than the first end. The post is positioned between the first and second walls such that the catch may engage one of the lugs.

8 Claims, 3 Drawing Sheets

POST REMOVAL DEVICE

BACKGROUND OF THE INVENTION

1. Field of the Invention

The present invention relates to post removal devices and more particularly pertains to a new post removal device for removing fence posts having lugs thereon.

2. Description of the Prior Art

The use of post removal devices is known in the prior art. More specifically, post removal devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,681,030; 2,926,890; 2,777,726; 5,499,795; 654,001; and U.S. Des. Pat. No. 337,412.

While these devices fulfill their respective, particular objectives and requirements, the aforementioned patents do not disclose a new post removal device. The inventive device includes an elongated member having a first end and a second end. The elongated member has middle portion, a first wall and a second wall such that the elongated member generally has U-shaped cross-section taken traverse to a longitudinal axis of the elongated member. A plate is attached to the first end of the elongated member. The plate lies in a plane orientated generally perpendicular to the longitudinal axis of the plate. A catch is attached to the elongated member and is positioned nearer the second end than the first end. The catch comprises a panel having a first edge, a second edge, a third edge and a fourth edge. The first edge is integrally attached to the middle portion and each of the second and third edges is attached to one of the first and second walls. The panel is in an angular relationship with the middle portion such that the panel generally extends toward the second end of the elongate member. The post is positioned between the first and second walls such that the catch may engage one of the lugs.

In these respects, the post removal device according to the present invention substantially departs from the conventional concepts and designs of the prior art, and in so doing provides an apparatus primarily developed for the purpose of removing fence posts having lugs thereon.

SUMMARY OF THE INVENTION

In view of the foregoing disadvantages inherent in the known types of post removal devices now present in the prior art, the present invention provides a new post removal device construction wherein the same can be utilized for removing fence posts having lugs thereon.

The general purpose of the present invention, which will be described subsequently in greater detail, is to provide a new post removal device apparatus and method which has many of the advantages of the post removal devices mentioned heretofore and many novel features that result in a new post removal device which is not anticipated, rendered obvious, suggested, or even implied by any of the prior art post removal devices, either alone or in any combination thereof.

To attain this, the present invention generally comprises an elongated member having a first end and a second end. The elongated member has middle portion, a first wall and a second wall such that the elongated member generally has U-shaped cross-section taken traverse to a longitudinal axis of the elongated member. A plate is attached to the first end of the elongated member. The plate lies in a plane orientated generally perpendicular to the longitudinal axis of the plate. A catch is attached to the elongated member and is positioned nearer the second end than the first end. The catch comprises a panel having a first edge, a second edge, a third edge and a fourth edge. The first edge is integrally attached to the middle portion and each of the second and third edges is attached to one of the first and second walls. The panel is in an angular relationship with the middle portion such that the panel generally extends toward the second end of the elongate member. The post is positioned between the first and second walls such that the catch may engage one of the lugs.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new post removal device apparatus and method which has many of the advantages of the post removal devices mentioned heretofore and many novel features that result in a new post removal device which is not anticipated, rendered obvious, suggested, or even implied by any of the prior art post removal devices, either alone or in any combination thereof.

It is another object of the present invention to provide a new post removal device which may be easily and efficiently manufactured and marketed.

It is a further object of the present invention to provide a new post removal device which is of a durable and reliable construction.

An even further object of the present invention is to provide a new post removal device which is susceptible of a low cost of manufacture with regard to both materials and labor, and which accordingly is then susceptible of low prices of sale to the consuming public, thereby making such post removal device economically available to the buying public.

Still yet another object of the present invention is to provide a new post removal device which provides in the apparatuses and methods of the prior art some of the advantages thereof, while simultaneously overcoming some of the disadvantages normally associated therewith.

Still another object of the present invention is to provide a new post removal device for removing fence posts having lugs thereon.

Yet another object of the present invention is to provide a new post removal device which includes an elongated member having a first end and a second end. The elongated member has middle portion, a first wall and a second wall such that the elongated member generally has U-shaped cross-section taken traverse to a longitudinal axis of the elongated member. A plate is attached to the first end of the elongated member. The plate lies in a plane orientated generally perpendicular to the longitudinal axis of the plate. A catch is attached to the elongated member and is positioned nearer the second end than the first end. The catch comprises a panel having a first edge, a second edge, a third edge and a fourth edge. The first edge is integrally attached to the middle portion and each of the second and third edges is attached to one of the first and second walls. The panel is in an angular relationship with the middle portion such that the panel generally extends toward the second end of the elongate member. The post is positioned between the first and second walls such that the catch may engage one of the lugs.

Still yet another object of the present invention is to provide a new post removal device that lifts up fence posts by engaging the lugs on the post.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
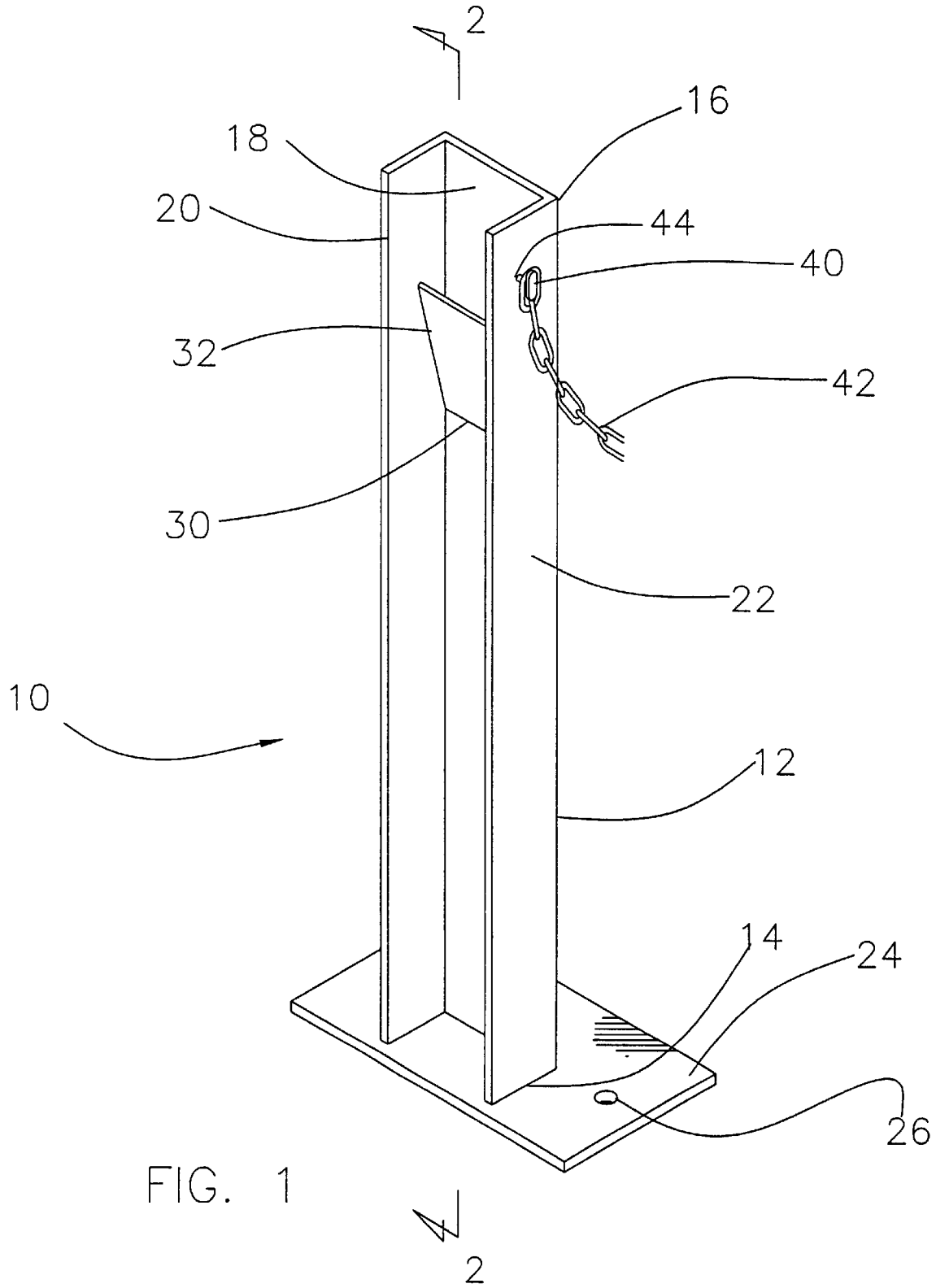
FIG. 1 is a schematic perspective view of a new post removal device according to the present invention.
Figure 2:
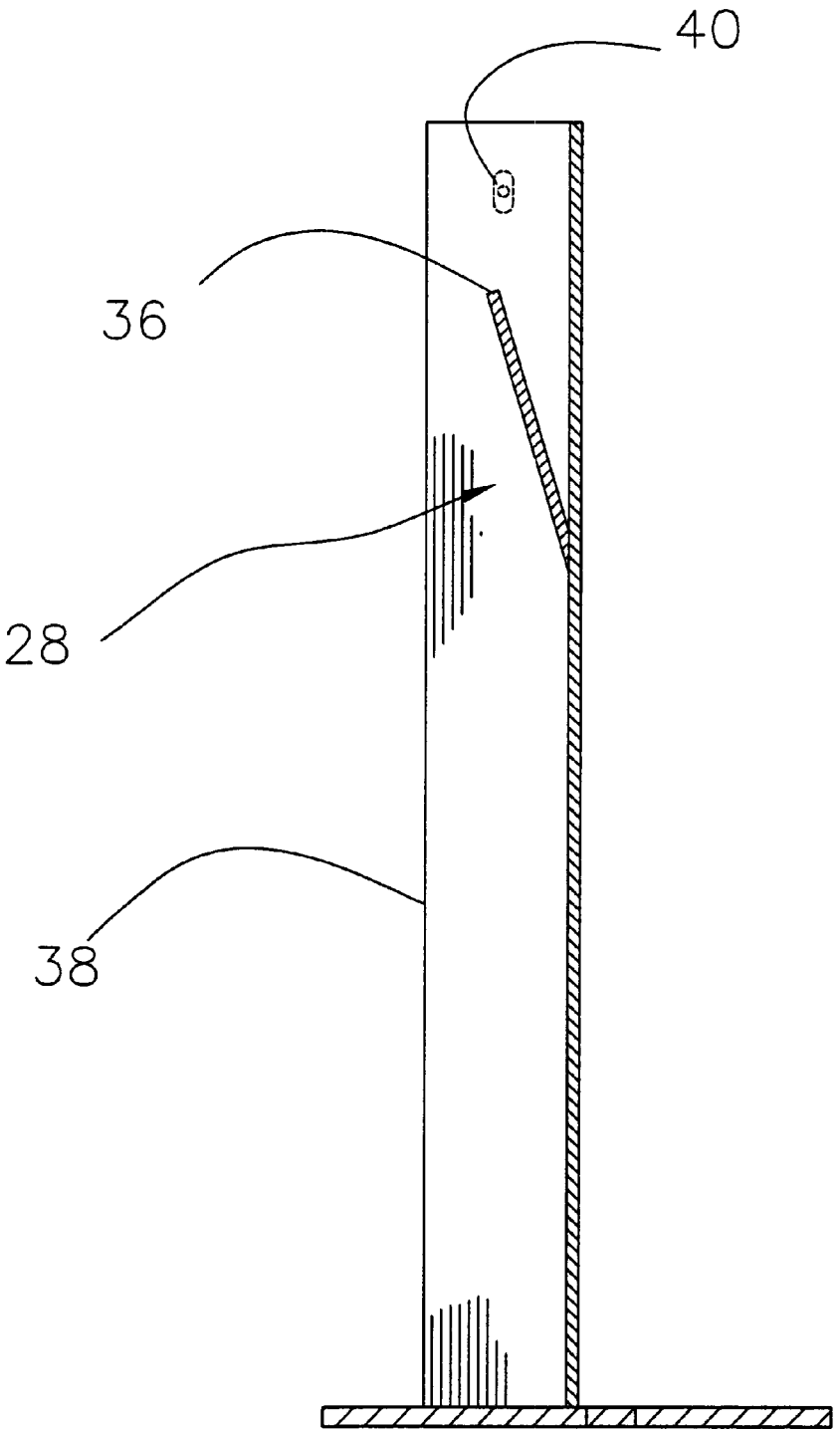
FIG. 2 is a schematic cross-sectional view taken along line 2—2 of FIG. 1 of the present invention.
Figure 3:
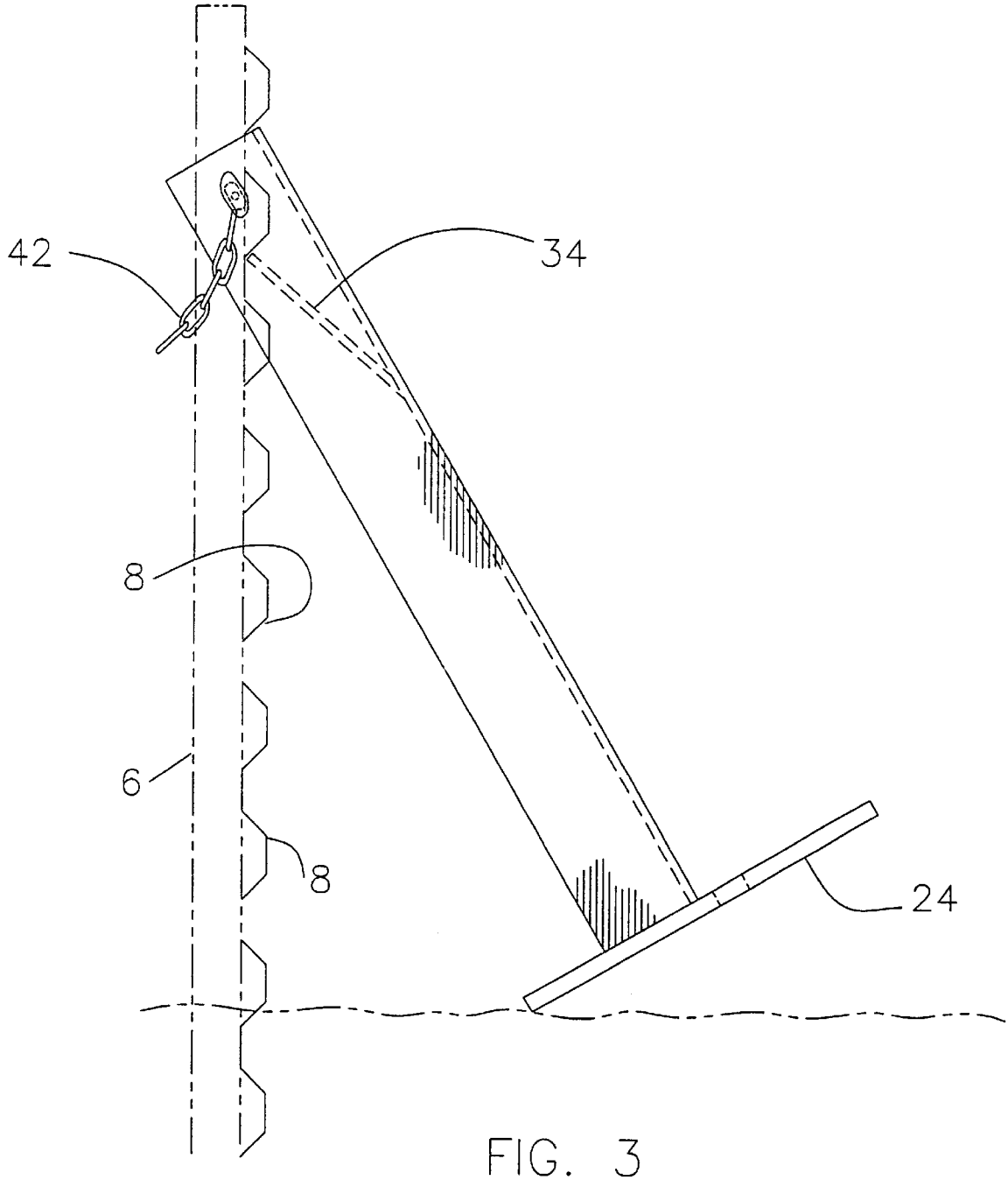
FIG. 3 is a schematic side view of the present invention.

With reference now to the drawings, and in particular to FIGS. 1 through 3 thereof, a new post removal device embodying the principles and concepts of the present invention and generally designated by the reference numeral 10 will be described.

As best illustrated in FIGS. 1 through 3, the post removal device 10 generally comprises a device for removing a fence post 6 having a plurality of aligned lugs 8 thereon extending between opposite ends of the fence post. The device includes an elongated member 12 having a first end 14 and a second end 16. The elongated member 12 has middle portion 18, a first wall 20 and a second wall 22 such that the elongated member 12 generally has U-shaped cross-section taken traverse to a longitudinal axis of the elongated member. The first 20 and second 22 walls are spaced more than two inches from each other. The elongated member 12 ideally has a length equal to 18 inches.

A plate 24 is attached to the first end 14 of the elongated member 12. The plate 24 lies in a plane orientated generally perpendicular to the longitudinal axis of the plate 24. The plate 24 has at least one opening 26 extending therethrough.

A catch 28 is attached to the elongated member and is positioned nearer the second end 16 than the first end 14. The catch 28 comprises a panel having a first edge 30, a second edge 32, a third edge 34 and a fourth edge 36. The first edge 30 is integrally attached to the middle portion 18 and each of the second 32 and third 34 edges is attached to one of the first 20 and second 22 walls. The panel, or catch 28, is in an angular relationship with the middle portion 18 such that the panel 28 generally extends toward the second end 16 of the elongate member 12. The angular relationship is preferably between 25 degrees and 50 degrees. The fourth edge 36 is spaced from the second end 16 of the elongated member 12 and is positioned between the middle portion 18 and outer edge 38 of the first 20 and second 22 walls. When making the device, the catch 28 may be punched out from the middle portion 18 such that the catch is integral with the middle portion 18.

Each of a pair of nubs 40 is attached to an outer surface of each of the first 20 and second 22 walls. Each of the nubs 40 is positioned generally adjacent to the second end 16 of the elongated member 12. An elongated flexible member 42 has a first end 44 attached to a first of the nubs 40. The elongated flexible member 42 is removably attachable to a second of the nubs 40 and preferably comprises a chain. Alternatively, an end of the chain may be welded to the first wall such that the nub 40 and that wall is eliminated. This will help insure that the chain is not lost.

In use, the post 6 is positioned between the first 20 and second 22 walls such that the catch 28 may engage one of the lugs 8. The elongated flexible member 42 may be positioned around the post. The post is pulled toward the elongate member 12 such that the elongate member moves toward a vertical orientation such that the post 6 is pulled upward. The post is then pushed away and pulled once again toward the device such that the catch may engage another of the lugs of the post. In this manner the catch 28 acts like a ratchet. This movement is repeated until the post is removed from the ground. The plate 24 has openings 26 therein so that planks may be attached to a bottom surface of the plate with a fasteners to provide a more stable surface during soft ground conditions.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A post removing device for removing a fence post having a plurality of aligned lugs thereon extending between opposite ends of the fence post, said device comprising:

an elongated member having a first end and a second end, said elongated member having middle portion, a first wall and a second wall such that said elongated member generally has U-shaped cross-section taken traverse to a longitudinal axis of said elongated member;

a plate being attached to said first end of said elongated member, said plate lying in a plane orientated generally perpendicular to said longitudinal axis of said plate;

a catch being attached to said elongated member and being positioned nearer said second end than said first end, said catch comprising a panel having a first edge, a second edge, a third edge and a fourth edge, said first edge being integrally attached to said middle portion and each of said second and third edges being attached to one of said first and second walls, said panel being in an angular relationship with said middle portion such that said panel generally extends toward said second end of said elongate member; and wherein the post is positioned between said first and second walls such that said catch may engage one of said lugs.

2. The post removing device as in claim 1, wherein said first and second walls are spaced more than two inches from each other.

3. The post removing device as in claim 1, wherein said plate has at least one opening extending therethrough.

4. The post removing device as in claim 1, wherein said angular relationship between said panel and said middle portion is generally between 25 degrees and 50 degrees.

5. The post removing device as in claim 1, wherein said fourth edge is spaced from said second end of said elongated member.

6. The post removing device as in claim 5, wherein said fourth edge generally is positioned between said middle portion and outer edge of said first and second walls.

7. The post removing device as in claim 1, further comprising:

a pair of nubs being attached to an outer surface of each of said first and second walls, each of said nubs being positioned generally adjacent to said second end of said elongated member; and an elongated flexible member having a first end attached to a first of said nubs, said elongated flexible member being removably attachable to a second of said nubs.

8. A post removing device for removing a fence post having a plurality of aligned lugs thereon extending between opposite ends of the fence post, said device comprising:

an elongated member having a first end and a second end, said elongated member having middle portion, a first wall and a second wall such that said elongated member generally has U-shaped cross-section taken traverse to a longitudinal axis of said elongated member, said first and second walls being spaced more than two inches from each other;

a plate being attached to said first end of said elongated member, said plate lying in a plane orientated generally perpendicular to said longitudinal axis of said plate, said plate having at least one opening extending therethrough;

a catch being attached to said elongated member and being positioned nearer said second end than said first end, said catch comprising a panel having a first edge, a second edge, a third edge and a fourth edge, said first edge being integrally attached to said middle portion and each of said second and third edges being attached to one of said first and second walls, said panel being in an angular relationship with said middle portion such that said panel generally extends toward said second end of said elongate member, said fourth edge being spaced from said second end of said elongated member, said fourth edge generally being positioned between said middle portion and outer edge of said first and second walls;

a pair of nubs being attached to an outer surface of each of said first and second walls, each of said nubs being positioned generally adjacent to said second end of said elongated member;

an elongated flexible member having a first end attached to a first of said nubs, said elongated flexible member being removably attachable to a second of said nubs; and wherein the post is positioned between said first and second walls such that said catch may engage one of said lugs, wherein said elongated flexible member may be positioned around the post.

* * * * *